US010109401B2

(12) United States Patent
Wu et al.

(10) Patent No.: US 10,109,401 B2
(45) Date of Patent: Oct. 23, 2018

(54) METHOD FOR INCREASING COERCIVE FORCE OF MAGNETS

(71) Applicant: Tianhe (Baotou) Advanced Tech Magnet Co., Ltd., Baotou (CN)

(72) Inventors: Shujie Wu, Baotou (CN); Yi Dong, Baotou (CN); Shulin Diao, Baotou (CN); Haibo Yi, Baotou (CN); Yichuan Wang, Baotou (CN); Zhanjiang Hu, Baotou (CN); Juchang Miao, Baotou (CN); Yi Yuan, Baotou (CN); Ya Chen, Baotou (CN); Wenjie Yuan, Baotou (CN)

(73) Assignee: Tianhe (Baotou) Advanced Tech Magnet Co., Ltd. (CN)

( * ) Notice: Subject to any disclaimer, the term of this patent is extended or adjusted under 35 U.S.C. 154(b) by 0 days.

(21) Appl. No.: 15/060,267

(22) Filed: Mar. 3, 2016

(65) Prior Publication Data

US 2017/0062103 A1 Mar. 2, 2017

(30) Foreign Application Priority Data

Aug. 28, 2015 (CN) ..... 2015 1 0543699

(51) Int. Cl.

| | |
|---|---|
| ***H01F 1/03*** | (2006.01) |
| ***H01F 41/02*** | (2006.01) |
| ***B05D 3/00*** | (2006.01) |
| ***H01F 41/22*** | (2006.01) |
| ***H01F 41/24*** | (2006.01) |
| *H01F 1/057* | (2006.01) |

(52) U.S. Cl.

CPC ..... *H01F 1/0306* (2013.01); *B05D 3/007* (2013.01); *H01F 41/0293* (2013.01); *H01F 41/22* (2013.01); *H01F 41/24* (2013.01); *H01F 1/0577* (2013.01)

(58) Field of Classification Search

CPC ..... H01F 7/02; H01F 1/053; H01F 1/0536; H01F 41/0253

USPC ..... 428/822.3

See application file for complete search history.

(56) References Cited

U.S. PATENT DOCUMENTS

| | | | | |
|---|---|---|---|---|
| 3,539,376 | A * | 11/1970 | Sumio | B41M 5/10 427/152 |
| 2008/0006345 | A1* | 1/2008 | Machida | C22C 29/14 148/120 |
| 2009/0297699 | A1* | 12/2009 | Baba | H01F 41/026 427/127 |
| 2010/0231338 | A1* | 9/2010 | Morimoto | C22C 1/0475 335/302 |
| 2012/0139388 | A1* | 6/2012 | Iwasaki | B22F 3/24 310/254.1 |
| 2013/0026870 | A1* | 1/2013 | Baba | C22C 38/005 310/152 |
| 2014/0352847 | A1* | 12/2014 | Yu | B22F 3/26 148/104 |

FOREIGN PATENT DOCUMENTS

| | | |
|---|---|---|
| CN | 101316674 A | 12/2008 |
| CN | 101331566 A | 12/2008 |
| CN | 102568806 A | 7/2012 |

* cited by examiner

*Primary Examiner* — Tabassom Tadayyon Eslami
(74) *Attorney, Agent, or Firm* — Lerner, David, Littenberg, Krumholz & Mentlik, LLP

(57) ABSTRACT

The present invention provides a method for improving coercive force of magnets, this method comprises steps as follows: S2) coating step: coating a coating material on the surface of a magnet and drying it; and S3) infiltrating step: heat treating the magnet obtained from the coating step S2). The coating material comprises (1) metal calcium particles and (2) particles of a material containing a rare earth element; the rare earth element is at least one selected from Praseodymium, Neodymium, Gadolinium, Terbium, Dysprosium, Holmium, Erbium, Thulium, Ytterbium and Lutetium. The method of the present invention can significantly increase coercive force of a permanent magnet material, while remanence and magnetic energy product hardly decrease. In addition, the method of the present invention can significantly decrease the amount of a rare earth element, and accordingly, decrease the production cost.

1 Claim, No Drawings

METHOD FOR INCREASING COERCIVE FORCE OF MAGNETS

CROSS REFERENCE TO RELATED APPLICATIONS

The present application claims priority from Chinese patent Application No. 201510543699.0, filed Aug. 28, 2015, the disclosure of which is incorporated herein by reference.

TECHNICAL FIELD OF THE INVENTION

The present invention relates to a method for increasing coercive force of magnets, in particular to a method for increasing coercive force of a rare earth magnet.

BACKGROUND OF THE INVENTION

As demands for hybrid vehicles, pure electric vehicles and energy-efficient air-conditioning compressor are growing, demands for rare earth permanent magnet material (such as an R—Fe—B-based rare earth permanent magnet) with a high coercive force are growing. Conventional methods for increasing coercive force need to use a large amount of heavy rare earth element, resulting in a significant increase in cost of magnets and a sacrifice of parts of remanence and energy product. Microscopic studies have showed that the grain boundary plays an important role in increasing the coercive force of magnets. The heavy rare earth element goes into grain boundaries by diffusion and infiltration (referred to as infiltration), so that the coercive force can be significantly increased by using less heavy rare earth, without sacrificing the remanence and magnetic energy product, which effectively reduces the cost of magnets.

There have been some methods in the prior art which improve grain boundaries by diffusion and infiltration. However, an increase of coercive force normally bring adverse effects such as a significant decrease of remanence and magnetic energy product, a large amount of heavy rare earth element, a complex process that is so difficult to control and so on.

CN101316674A discloses a method for preparing a rare earth permanent magnet material. The method comprises the steps of disposing a powder of an oxyfluoride of a rare earth element on a surface of a magnet, treating the magnet at a temperature equal to or below the sintering temperature of the magnet so that the rare earth element is absorbed in the magnet, to thereby obtain a magnet with high performance by using a minimized amount of Tb or Dy. In this method, a powder of an oxyfluoride of a heavy rare earth element is diffused. The heavy rare earth element, on one hand, is detached from the oxyfluoride compound, on the other hand, needs to diffuse to the inside of the magnet. This needs a relatively long time for thermal insulation treatment, and may lead some problems. For example, a portion of the surface layer of the magnet becomes a Nd defect state and soft magnetic $\alpha$-Fe or $DyFe_2$ damages coercive force of the magnet. In addition, in this method, an oxyfluoride powder of heavy rare earth is dispersed in water or an organic solvent to obtain slurry, and then the slurry is disposed on the surface of the magnet. However, the slurry will be exfoliated easily during the operation due to the limited adhesive force between the slurry and the magnet, which results in an uneven absorption of the heavy rare earth element, thereby causing a poor consistency of performance of the magnet.

CN101331566A discloses an R—Fe—B rare earth sintered magnet and a method for producing the same. In this method, a sintered magnet and a container containing a heavy rare earth element are placed in the same processing chamber without contacting with each other; the heavy rare earth element is diffused from the surface of the magnet to the inside of the magnet by heating. In this method, non-contact diffusion and infiltration is adopted, so it can only rely on metal vapor. In this method, although diffusion can be even, the process is so difficult to control. If the temperature is too low, heavy rare earth vapor is difficult to diffuse from the surface of the magnet to the inside of the magnet, and the treatment time is significantly prolonged; when the temperature is too high, the formed heavy rare earth vapor of high concentration is much more than the vapor diffused to the inside of the magnet, so that a layer of heavy rare earth element is formed on the surface of the magnet, leading to a greatly reduced effect of grain boundary diffusion.

CN102568806A discloses a method for preparing rare-earth permanent magnets by the infiltration process, in which a fluoride of a heavy rare earth type element and metal calcium particles are placed at the bottom of a graphite box; and then slices of the magnet are placed; the fluoride of the heavy rare earth type element is reduced by the metal calcium; and then a heavy metal vapor is diffused to grain boundary phase of the magnet. This process is not described in detail, and can not be carried out easily. For example, details such as the fluoride of the heavy rare earth type element and the size of calcium particles which significantly affect the results of implementations are not mentioned. Moreover, the reduced heavy rare earth element is still diffused by a vapor process. Thus, there are deficiencies similar to those of CN101331566A.

SUMMARY OF THE INVENTION

An object of the present invention is to provide a method for increasing coercive force of magnets, which can significantly increase coercive force of a permanent magnet material with less decrease in remanence and magnetic energy product.

A further object of the present invention is to provide a method for increasing coercive force of magnets, which can significantly decrease the amount of a rare earth element (especially, a heavy rare earth element), so that the production cost is decreased.

The present invention provides a method for increasing coercive force of magnets, which comprises steps as follows:

S2) coating step: coating a coating material on the surface of a magnet and drying it; and S3) infiltrating step: heat treating the magnet obtained from the coating step S2);

wherein the coating material comprises (1) metal calcium particles and (2) particles of a material containing a rare earth element; the rare earth element is at least one selected from Praseodymium, Neodymium, Gadolinium, Terbium, Dysprosium, Holmium, Erbium, Thulium, Ytterbium and Lutetium.

In accordance with the method of the present invention, preferably, in the coating step S2), the material containing a rare earth element is selected from:

a1) an elementary substance of a rare earth element;

a2) an alloy containing a rare earth element;

a3) a compound containing a rare earth element; or a4) a mixture of the above materials.

In accordance with the method of the present invention, preferably, in the coating step S2), the material containing a rare earth element is selected from halides, oxides and nitrides of a rare earth element.

In accordance with the method of the present invention, preferably, the metal calcium particles and the particles of the material containing rare earth element both have an average particle size smaller than 100 μm.

In accordance with the method of the present invention, preferably, the coating material is a colloidal solution which contains metal calcium particles, particles of a material containing rare earth element and an organic solvent; the organic solvent is at least one selected from aliphatic hydrocarbons, alicyclic hydrocarbons, alcohols and ketones.

In accordance with the method of the present invention, preferably, in the coating material, a weight ratio of the metal calcium particles to the particles of the material containing rare earth element is 1:2-5.

In accordance with the method of the present invention, preferably, the infiltrating step S3) comprises:

S3-1) reduction step: under anaerobic conditions, keeping at a first temperature and reducing the rare earth element by metal calcium, while allowing a part of the rare earth element to be diffused to the grain boundary inside the magnet; and S3-2) diffusion step: increasing the temperature to a second temperature and keeping the temperature, and allowing the reduced rare earth element to be further diffused to the grain boundary inside the magnet along the grain boundary;

wherein the first temperature and the second temperature are both higher than 600° C. and both lower than the sintering temperature of the magnet.

In accordance with the method of the present invention, preferably, in the reduction step S3-1), keeping at the first temperature for 1-3 hours, wherein the first temperature is 600° C.-1060° C.; and in the diffusion step S3-2), keeping at the second temperature for 3-8 hours, wherein the second temperature is 600° C.-1060° C.

In accordance with the method of the present invention, preferably, the method further comprises steps as follows:

S1) magnet manufacturing step: sintering to manufacture the magnet in the coating step S2); and S4) aging treatment step: aging treating the magnet obtained from the infiltrating step S3).

In accordance with the method of the present invention, preferably, in the aging treatment step S4), the temperature for the aging treatment is 400° C.-1020° C., the time for the aging treatment is 0.5-10 hours.

For the sintered magnet treated by the present method, its remanence and magnetic energy product do not vary obviously, while its coercive force increases significantly. The method of the present invention can significantly improve the effect of reducing rare earth element, and further improve the effect of diffusing and infiltrating the rare earth element to the inside of the magnet. Further, using a colloidal solution obtained from fine calcium particles and particles containing a rare earth element compound, on one hand, can improve the effect of reducing the rare earth element by the calcium metal, and on the other hand, can increase the adherence force between the rare earth element and the magnet, so as to enhance homogeneousness and uniformity of performance of the magnet subjected to the diffusion and infiltration. In addition, as the colloidal solution is composed of an organic solution, it will evaporate in a high temperature reduction process, leaving no residue, and will not contaminate the magnet. The method of the present invention can significantly increase the coercive force of magnets by using relatively small amount of rare earth, effectively lower the production cost of magnets; and the operation process is easy, and suitable for a large scale industrial application.

DETAIL DESCRIPTION OF THE INVENTION

The present invention will be further explained in combination with specific embodiments, but the protection scope of the present invention is not limited thereto.

The "remanence" in the present invention refers to the value of the magnetic flux density at the point on the saturant magnetic hysteresis loop where the magnetic field strength is zero, and is commonly referred to as $B_r$ or $M_r$, with the unit of Tesla (T) or Gauss (Gs).

The "coercive force" in the present invention refers to the reverse magnetic field strength which is required to make the residue magnetization strength Mr of magnet decreased to zero, with the unit of Oersted (Oe) of Ampere/Meter (A/M).

The "magnetic energy product" in the present invention refers to the product of the magnetic flux density (B) of any point on the demagnetization curve and the corresponding magnetic field strength (H), and is commonly referred to as BH, with the unit of Gauss•Oersted (GOe).

The "rare earth element" in the present invention includes elements such as Praseodymium (Pr), Neodymium (Nd), Gadolinium (Gd), Terbium (Tb), Dysprosium (Dy), Holmium (Ho), Erbium (Er), Thulium (Tm), Ytterbium (Yb), Lutetium (Lu).

The "inert atmosphere" in the present invention refers to the atmosphere which does not react with rare earth magnets and not affect their magnetism. In the present invention, the "inert atmosphere" includes an atmosphere consisting of inert gases (helium, neon, argon, krypton, xenon).

In the present invention, a smaller value of vacuum degree represents a higher vacuum degree.

The method for increasing coercive force of a magnet of the present invention comprises a coating step S2) and an infiltrating step S3). Preferably, the method of the present invention further comprises a magnet manufacturing step S1) and an aging treatment step S4).

Magnets of the present invention may be rare earth sintered magnets, for example, R—Fe—B based rare earth magnet. R—Fe—B based rare earth magnet is an intermetallic compound mainly composed of a rare earth element R, iron and boron. In the present invention, R is one or more elements selected from Nd, Pr, La, Ce, Tb, Dy, Ho, Er, Eu, Sm, Gd, Pm, Tm, Yb, Lu, Y and Sc; preferably, R is one or more elements selected from Nd, Pr, La, Ce, Tb, Dy, Y and Sc; more preferably, R is Nd or a combination of Nd and other rare earth element(s). Fe represents iron element, and a part of iron can be replaced by an element of cobalt, aluminum, vanadium and so on. B represents boron element.

<Magnet Manufacturing Step S1)>

The manufacturing method of the present invention preferably comprises a magnet manufacturing step S1) to manufacture the magnet in the atomizing spray step S2). In the present invention, the magnet manufacturing step S1) preferably comprises steps as follows:

S1-1) smelting step: smelting rare earth magnet raw material so that the smelted rare earth magnet raw material forms a master alloy;

S1-2) powdering step: crushing the master alloy obtained from the smelting step S1-1) into magnetic powder;

S1-3) shaping step: pressing the magnetic powder obtained from the powdering step S1-2) into a green body for sintering under the action of an alignment magnetic field; and S1-4) sintering step: sintering the green body obtained from the shaping step S1-3) into a sintered rare earth magnet.

In accordance with a preferred embodiment of the present invention, the magnet manufacturing step S1) may further comprise a step as follows:

S1-5) cutting step: cutting the sintered rare earth magnet.

Smelting Step S1-1)

In order to prevent the oxidation of the sintered magnet raw material and the master alloy prepared therefrom, the smelting step S1-1) of the present invention is preferably carried out in vacuum or an inert atmosphere. In the smelting step S1-1), there is no particular limit on the rare earth magnet raw material or the ratio thereof, thus those raw materials and the ratio thereof which are well known in this field may be adopted. In the smelting step S1-1), smelting process preferably adopts an ingot casting process or a strip casting process. The ingot casting process includes cooling and solidifying the smelted R—Fe—B based rare earth sintered magnet raw material and producing it into an alloy ingot (master alloy). The strip casting process includes rapidly cooling and solidifying the smelted raw rare earth magnet material and spinning it into an alloy sheet (master alloy). In accordance with one preferred embodiment of the present invention, the smelting process adopts a strip casting process. The strip casting process of the present invention may be carried out in a vacuum intermediate frequency induction furnace. The smelting temperature may be 1100-1600° C., preferably 1450-1500° C. The thickness of the alloy sheet (master alloy) of the present invention may be 0.01-5 mm, preferably 0.1-1 mm, more preferably 0.25-0.45 mm. In accordance with one specific embodiment of the present invention, the raw material is placed in a vacuum intermediate frequency induction furnace; and under the condition that the furnace is vacuumed to below 1 Pa, argon (Ar) is charged to provide protection and heat melting is carried out to form an alloy liquid; and then the alloy liquid is poured onto rotating cooling copper rolls, to prepare alloy sheets (master alloy) with a thickness of 0.25-0.45 mm; the alloy liquid temperature is controlled between 1450-1500° C.

Powdering Step S1-2)

The present invention adopts a powdering process S1-2) to prepare powder. In order to prevent the oxidation of the master alloy and the magnetic powder crushed therefrom, the powdering step S1-2) of the present invention is preferably carried out in vacuum or an inert atmosphere. The powdering process S1-2) of the present invention preferably comprises steps as follows:

S1-2-1) coarsely crushing step: crushing the master alloy into coarse magnetic powder with larger particle size; and S1-2-2) milling step: milling the coarse magnetic powder obtained from the coarsely crushing step S1-2-1) into fine magnetic powder.

In the present invention, the average particle size of the coarse magnetic powder obtained from coarsely crushing step S1-2-1) is 50-500 m, preferably 100-400 m, more preferably 200-300 m. In the present invention, the fine magnetic powder obtained from milling step S1-2-2) is 20 μm or less, preferably 10 μm or less, more preferably 3-5 μm.

In the coarsely crushing step S1-2-1) of the present invention, a mechanical crushing process and/or a hydrogen decrepitation process is adopted to crush the master alloy into coarse magnetic powder. The mechanical crushing process is a process to crush the master alloy into coarse magnetic powder using a mechanical crushing device; the mechanical crushing device may be selected from a jaw crusher or a hammer crusher. The hydrogen decrepitation process is as follows: firstly making master alloy absorb hydrogen at a low temperature, initializing the master alloy crystal lattice expend through the reaction between the master alloy and hydrogen so that the master alloy is crushed into coarse magnetic powder; then heating the coarse magnetic powder to desorb hydrogen at a high temperature. In accordance with a preferred embodiment of the present invention, the hydrogen decrepitation process of the present invention is preferably carried out in a hydrogen decrepitation furnace. In the hydrogen decrepitation process of the present invention, the alloy sheet is crushed under a hydrogen pressure, and then vacuum pumping is performed to desorb hydrogen, wherein the hydrogen pressure used for crushing may be 0.02-0.2 MPa, preferably 0.05-0.1 MPa; the temperature for vacuum pumping to desorb hydrogen may be 400-800° C., preferably 550-700° C.

In the milling step S1-2-2) of the present invention, a ball milling process and/or a jet milling process is adopted to crush the coarse magnetic powder into fine magnetic powder. The ball milling process is a process to crush the coarse magnetic powder into fine magnetic powder using a mechanical ball milling device. The mechanical ball milling device may be selected from a rolling ball mill, a vibration ball mill or a high energy ball mill. The jet milling process is a process to make the coarse magnetic powder accelerated and hit each other and then crushed by a gas flow. The gas flow may be a nitrogen flow, preferably a high purity nitrogen flow. The N2 content in the high purity nitrogen flow may be 99.0 wt % or more, preferably 99.9 wt % or more. The pressure of the gas flow may be 0.1-2.0 MPa, preferably 0.5-1.0 MPa, and more preferably 0.6-0.7 MPa.

In accordance with a preferred embodiment of the present invention, firstly, crushing the master alloy into coarse magnetic powder by the hydrogen decrepitation process; and then, crushing the coarse magnetic powder into fine magnetic powder by jet milling process. For example, hydrogenation of alloy sheets is carried out in a hydrogen decrepitation furnace, the alloy sheet turns into very loose particles after being crushed under a hydrogen pressure and the high temperature dehydrogenation, and then powder with an average particle size of 3-5 μm is prepared by jet milling.

Shaping Step S1-3)

A shaping step S1-3) is adopted to prepare a green body in the present invention. In order to prevent oxidation of magnetic powder, the shaping step S1-3) of the present invention is preferably carried out in vacuum or an inert atmosphere. In the shaping step S1-3), a pressing process of magnetic powder is preferably a mold pressing process and/or an isostatic pressing process. The isostatic pressing process of the present invention can be performed in an isostatic presser. The pressure for the pressing may be 100 MPa or more, and more preferably 200 MPa or more; the time for the pressing is 10-30 s, more preferably 15-20 s. In accordance with a preferred embodiment of the present invention, firstly, the mold pressing process is adopted to press the magnetic powder, and then the isostatic pressing process is adopted to press the magnetic powder. In the shaping step S1-3) of the present invention, the direction of the alignment magnetic field is parallel or perpendicular to the pressing direction of the magnetic powder. There is no particular limitation on the strength of the alignment magnetic field, which depends on practical desires. In accordance with the preferred embodiment of the present invention, the strength of the alignment magnetic field is at least 1 Tesla (T), preferably at least 1.5 T, and more preferably at least 1.8 T. In accordance with a preferred embodiment of the present invention, the shaping step S1-3) of the present invention is as follows: aligning the powder in a magnetic field with a strength larger than 1.8 T and pressing it to shape it, and then taking out the green body after demagnetization, vacuum pumping and sealing, and then pressing the sealed body under an isostatic pressure of 200 MPa or more for 15 s or more.

Sintering Step S1-4)

In order to prevent oxidation of the sintered body, the sintering step S1-4) of the present invention is preferably carried out in vacuum or an inert atmosphere. In accordance with a preferred embodiment of the present invention, the sintering step S1-4) is performed in a vacuum sintering furnace. In the present invention, the vacuum degree of the sintering step S1-4) may be less than 1.0 Pa, preferably less than $5.0\times10^{-1}$ Pa, more preferably less than $5.0\times10^{-2}$ Pa, for example, $1.0\times10^{-2}$ Pa. The sintering temperature may be 500-1200° C., preferably 700-1100° C., more preferably 1000-1050° C. In the sintering step S1-4), the sintering time may be 0.5-10 hours, preferably 1-8 hours, more preferably 3-5 hours. In accordance with a preferred embodiment of the present invention, the sintering step S1-4) of the present invention is as follows: the shaped green body is placed in a high vacuum furnace, and sintered under $1\times10^{-3}$ Pa-$1\times10^{-2}$ Pa at 1000-1050° C. for 3-5 h; and then argon is charged to cool the sintered body down to 60° C. or less, and the cooled body is discharged, to obtain a sintered blank block (master material).

Cutting Step S1-5)

In the cutting step S1-5) of the present invention, the cutting process adopts slicing processing and/or wire cut electrical discharge machining. The size of sliced magnet may be 10-60 mm×5-40 mm×1-10 mm, preferably 30-50 mm×20-30 mm×3-8 mm.

In the present invention, the magnet manufacturing step 51) is preferably performed before the atomizing coating step S2). To decrease the cost, the aging treatment is not performed in the magnet manufacturing step 51).

<Coating Step S2)>

The method of the present invention comprises coating step S2): the coating material containing metal calcium and a rare earth element is coated on the surface of the magnet and dried. The coating material contains metal calcium particles and particles of a material containing a rare earth element.

The average particle sizes of metal calcium particles and particles of the material containing rare earth element are 0.01-100 μm, preferably 0.1-50 μm. The inventors have found that it is not true that the smaller the particle size of metal calcium particles is, the better; if the particle is too small, the reduction effect may deteriorate. This may be related to the effect of environment (such as oxygen) on calcium particles. The average particle size of metal calcium particles is preferably 0.5-50 μm, more preferably 1-10 μm, particularly preferably 1-3 μm; the average particle size of particles of the material containing rare earth element is preferably 0.1-50 μm, more preferably 0.1-10 μm, particularly preferably 0.1-3 μm. The metal calcium particles of the present invention are preferably prepared by refining and crushing under anaerobic conditions. The particles of the material containing rare earth element of the present invention are preferably crushed in helium. Using helium as a jet milling media make it possible to crush the particles to a smaller and more uniform particle size In the coating material of the present invention, the weight ratio of metal calcium particles and particles of the material containing rare earth element may be 1:2-5, preferably 1:2.5-4.5, more preferably 1:3-4.

The material containing rare earth element of the present invention is selected from:

a1) an elementary substance of a rare earth element;

a2) an alloy containing a rare earth element;

a3) a compound containing a rare earth element; or a4) a mixture of the above materials.

In the alloy a2) containing rare earth element of the present invention, there is other metal element(s) in addition to the heavy rare earth element. Preferably, said other metal element(s) is at least one of aluminum, gallium, magnesium, tin, silver, copper and zinc.

The compound a3) containing rare earth element of the present invention is an inorganic or organic compound containing a rare earth element. The inorganic compound containing a rare earth element includes but is not limited to oxide, hydroxide or inorganic acid salts of the rare earth element. The organic compound containing a rare earth element includes but is not limited to organic acid salts, alkoxides or metal complexes of the rare earth element. In accordance with a preferred embodiment of the present invention, the compound a3) containing rare earth element of the present invention is a halide of the rare earth element, such as a fluoride, a chloride, a bromide or an iodide of the rare earth element.

The material containing rare earth element of the present invention may be one or more selected from a halide, an oxide and a nitride of the rare earth element. In the material containing rare earth element of the present invention, the rare earth element is at least one selected from praseodymium, neodymium, gadolinium, terbium, dysprosium, holmium, erbium, thulium, ytterbium and lutetium. In accordance with a preferred embodiment of the present invention, the rare earth element is at least one selected from dysprosium or terbium.

The present invention preferably adopts the following coating processes or a combination thereof:

S2-1) the metal calcium particles and particles of the material containing rare earth element are dispersed in a liquid medium to form a coating liquid in form of suspension or emulsion, and then the coating liquid in form of suspension or emulsion is utilized to coat the surface of R—Fe—B based rare earth sintered magnet; or S2-2) the metal calcium particles and particles of the material containing rare earth element are dispersed in an organic solvent with an addition of one or more organic binder to prepare a colloidal solution. The colloidal solution is utilized to coat the surface of R—Fe—B based rare earth sintered magnet. There is no particular limit on the organic solvent and the organic binder of the present invention as long as the metal calcium particles and particles of material containing rare earth element can be made into a colloidal solution. The organic solvent of the present invention is preferably at least one selected from aliphatic hydrocarbons, alicyclic hydrocarbons, alcohols and ketones. Specific examples include but are not limited to ethanol (alcohol), petrol, ethylene glycol, propylene glycol or glycerin. The organic binder of the present invention may be a resin binder or a rubber binder. Specific examples include but are not limited to epoxy resins, vinyl acetate resins, acrylic resins, butyl rubber, chlorinated rubber or the like. In the colloidal solution, the amount ratio of particles (the total of metal calcium particles and particles of the material containing rare earth element), an organic solvent and an organic binder is preferably 20-600 g:500 ml:0.1-10 g, more preferably 100-500 g:500 ml:0.2-5 g.

The drying (i.e., baking) process of the present invention may be those known in the art, and no further explanation is given herein. The baking temperature is preferably 50-200° C., more preferably 100-150° C.; the baking time is preferably 0.5-5 hours, and more preferably 1-3 hours. Preferably, the drying process is carried out under the protection of an inert atmosphere, more effectively, under the protection of an atmosphere of nitrogen with a concentration of 99.99%. After drying, the material containing metal calcium and rare earth element is uniformly and densely attached to the surface of the sintered rare earth magnet.

<Infiltrating Step S3)>

The infiltrating step S3) of the present invention is to perform heat treatment on the sintered rare earth magnet obtained from the coating step S2). The infiltrating step S3) comprises:

S3-1) reduction step: under anaerobic conditions, keeping at a first temperature to reduce the rare earth element by calcium metal, while allowing a part of the rare earth element to be diffused to the grain boundary inside the magnet;

S3-2) diffusion step: increasing the temperature to a second temperature and keeping the temperature, and allowing the reduced rare earth element to be further diffused to grain boundary inside the magnet along the grain boundary.

In the present invention, the first temperature and the second temperature are both higher than 600° C. and both lower than the sintering temperature of the magnet. The first temperature and the second temperature are preferably 600-1060° C. More preferably, in the reduction step S3-1), the temperature is kept at the first temperature for 1-3 hours, the first temperature is 700-800° C.; in the diffusion step S3-2), the temperature is kept at the second temperature for 3-8 hours, the second temperature is 900-1060° C.

The infiltrating step S3) is preferably carried out in vacuum or an inert atmosphere. In accordance with a preferred embodiment of the present invention, the infiltrating step S3) is carried out in a vacuum sintering furnace. The absolute vacuum degree of the infiltrating step S3) of the present invention is preferably smaller than or equals to 0.01 Pa, more preferably smaller than or equals to 0.005 Pa, further preferably smaller than or equals to 0.0005 Pa.

In accordance with a preferred embodiment of the present invention, the heat treatment process is as follows: placing the sintered rare earth magnet obtained from the coating step S2) in a vacuum sintering furnace; vacuum pumping the sintering furnace to 0.005 Pa or less and starting to heat; increasing the temperature to 700-750° C. at a speed of 5-15° C./min, and then increasing the temperature to 750-780° C. at a speed of 1-5° C./min, and keeping at this temperature for 1-3 h to make the displacement reduction reaction occur between metal calcium and the material containing rare earth element, and to diffuse a part of the displaced rare earth element or the rare earth element of the material containing a rare earth element to the grain boundary inside the magnet. Then the temperature is increased to 900-1000° C. at a speed of 3-8° C./min, and is kept at this temperature for 3-8 h to further sufficiently diffuse the rare earth element to the grain boundary inside the magnet.

<Aging Treatment Step S4)>

In the aging treatment step S4) of the present invention, aging treatment is carried out on the sintered rare earth magnet. To prevent oxidation of the sintered rare earth magnet, the aging treatment step S4) of the present invention is preferably carried out in vacuum or inert atmosphere. In the present invention, the temperature of the aging treatment may be 400-900° C., preferably 450-550° C.; the time of the aging treatment may be 0.5-10 hours, preferably 1-6 hours. In accordance with a preferred embodiment of the present invention, the aging treatment step S4) is: charging an inert atmosphere to cool down to 60° C. or less, and then keeping at 480-500° C. under 1 Pa or less for 3-6 h, and charging an inert atmosphere again to cool down to 60° C. or less.

Example 1

S1) Magnet Manufacturing Step:

S1-1) smelting step: the raw material was formulated with the atomic percentages as follows: 12.5% of Nd, 1.5% of Dy, 0.5% of Al, 0.5% of Co, 0.05% of Cu, 0.2% of Nb, 5.9% of B and the balance of Fe; under the protection of argon, intermediate frequency induction was utilized to heat and melt the raw material in a vacuum sintering furnace; and then the product was poured onto rotating cooling copper rolls at 1480° C., to obtain an alloy sheet with an average thickness of 0.3 mm.

S1-2) Powdering Step:

S1-2-1) coarsely crushing step: hydrogen decrepitation was performed on the alloy sheet under 0.1 MPa of hydrogen, and then dehydrogenation was performed by vacuum pumping at 550° C., and coarse powder with a particle size of around 300 μm was obtained;

S1-2-2) milling step: the coarse powder was milled into fine powder with a particle size of 3 μm through jet milling.

S1-3) shaping step: the fine powder was pressed into a green body on a forming presser under the protection of nitrogen in an alignment magnetic field more than 1.8 T, the green body was sealed during vacuum pumping, and then the sealed green body was pressed under an isostatic pressure which is 200 MPa or more for 15 s or more.

S1-4) sintering step: the shaped body was placed in a high vacuum sintering furnace, and was sintered under $1\times10^{-2}$ Pa at 1050° C. for 4 h; and then argon was charged to cool the magnet down to 60° C. or less discharge and obtain a sintered blank block.

S1-5) cutting step: the obtained blank block was sliced and ground to obtain magnet slices with 40×25×5 mm.

S2) coating step: the metal calcium was crushed into metal particles with an average particle size of 1.5 μm under the protection of nitrogen. Dysprosium fluoride was crushed into particles with an average particle size of 1.5 μm under the protection of helium by a jet milling method. The calcium metal particles and dysprosium fluoride particles were dispersed in ethanol solution at a weight ratio of 1:3.5 with an addition of an epoxy resin binder to prepare an organic colloidal solution. In the colloidal solution, the amount ratio of particles (the total of metal calcium particles and dysprosium fluoride particles), the organic solvent and the epoxy resin was 200 g:500 ml:0.5 g. Then the homogeneously mixed colloidal solution was uniformly coated on the surface of the magnet. The colloid was dried under the protection of an atmosphere of nitrogen with a concentration of 99.99%.

S3) infiltrating step: the dried magnet was evenly placed in a graphite box and sealed with a cover. Then the graphite box was placed in a vacuum sintering furnace.

S3-1) reduction step: the sintering furnace was vacuumed to $5\times10^{-3}$ Pa or less and then heated; the temperature was increased to 720° C. at a speed of 10° C./min, and then the temperature was increased to 780° C. at a speed of 2°

C./min, and kept at this temperature for 2 h to make the displacement reduction reaction occur between calcium and dysprosium fluoride, and to diffuse a part of the displaced dysprosium element or the dysprosium element in the dysprosium fluoride to the grain boundary inside the magnet.

S3-2) diffusion step: the temperature was increased to 950° C. at a speed of 5° C./min, and this temperature was kept for 5 h to further sufficiently diffuse the dysprosium element to the grain boundary inside the magnet.

S4) aging treatment step: helium was charged to cool the magnet down to 60° C. or less, and then the magnet was kept at 490° C. under 1 Pa or less for 4 h to perform aging treatment, and helium was charged again to cool the magnet down to 60° C. or less to discharge and obtain Sample 1#.

Comparative Example 1

Compared with Example 1, neither coating step S2) nor infiltrating step S3) was performed; and the other conditions were the same with Example 1. Sample 2# was obtained.

Comparative Example 2

Compared with Example 1, the difference is that the coating step S2) is different. The coating step S2) of Comparative example 2 is as follows: dysprosium fluoride particles with an average particle size of 300 μm were dispersed in ethanol solution with an addition of an epoxy resin binder to prepare an organic colloidal solution. In the colloidal solution, the amount ratio of particles, the organic solvent and the epoxy resin was 200 g:500 ml:0.5 g. Then the homogeneously mixed colloidal solution was uniformly coated on the surface of the magnet. The colloid was dried under the protection of an atmosphere of nitrogen with a concentration of 99.99%. The other conditions were the same with Example 1. Sample 3# is obtained.

Comparative Example 3

Compared with Example 1, the difference is that no metal calcium particle was added in the coating step S2); and the other conditions were the same with Example 1. Sample 4# was obtained.

Comparative Example 4

Compared with Example 1, the ratio of materials in the magnet manufacturing step 51) was different and neither the coating step S2) nor infiltrating step S3) was performed. In comparative Example 4, the raw material was formulated with the atomic percentages as follows: 11.5% of Nd, 2.5% of Dy, 0.5% of Al, 0.5% of Co, 0.05% of Cu, 0.2% of Nb, 5.9% of B and the balance of Fe. The other steps were identical to Example 1. Sample 5# was obtained.

Example 2

S1) Magnet Manufacturing Step

S1-1) smelting step: the raw material was formulated with the atomic percentages as follows: 12.5% of Nd, 1.5% of Dy, 0.5% of Al, 0.5% of Co, 0.05% of Cu, 0.2% of Nb, 5.9% of B and the balance of Fe; in an environment under protection of argon, intermediate frequency induction was utilized to heat and melt the raw materials in a vacuum sintering furnace; and then the product was poured onto rotating cooling copper rolls at 1480° C., and an alloy sheet was prepared with a thickness of 0.3 mm.

S1-2) Powdering Step:

S1-2-1) coarsely crushing step: hydrogen decrepitation was performed on the alloy sheet under 0.08 MPa of hydrogen, and then dehydrogenation was performed by vacuum pumping at 550° C., and coarse powder with a particle size of around 300 μm was obtained.

S1-2-2) milling step: the coarse powder was milled into fine powder with a particle size of 3.0 μm through jet milling.

S1-3) shaping step: the fine powder was pressed into a green body by a forming presser under the protection of nitrogen in an alignment magnetic field more than 1.8 T, the green body was sealed during vacuum pumping, and then the sealed body was pressed under an isostatic pressure which is 200 MPa or more for 15 s or more.

S1-4) sintering step: the shaped body was placed in a high vacuum sintering furnace, and was sintered under $1\times10^{-2}$ Pa at 1050° C. for 4 h; and then argon was charged to cool the magnet down to 60° C. or less to discharge and obtain a sintered blank block.

S1-5) cutting step: the obtained blank block was sliced and ground to obtain magnet slices with 40×25×5 mm.

S2) coating step: the metal calcium was crushed into metal particles with an average particle size of 1.5 μm under the protection of nitrogen. Terbium fluoride was crushed into particles with an average particle size of 1.5 μm under the protection of helium by a jet milling method. The calcium metal particles and terbium fluoride particles were dispersed in ethanol solution at a weight ratio of 1:3.5 with an addition of an epoxy resin binder to prepare an organic colloidal solution. In the colloidal solution, the amount ratio of particles (the total of metal calcium particles and terbium fluoride particles), the organic solvent and the epoxy resin was 200 g:500 ml:0.5 g. Then the homogeneously mixed colloidal solution was uniformly coated on the surface of the magnet. The colloid was dried under the protection of an atmosphere of nitrogen with a concentration of 99.99%.

S3) infiltrating step: the dried magnet was evenly placed in a graphite box and sealed with a cover. Then the graphite box was placed in a vacuum sintering furnace.

S3-1) reduction step: the sintering furnace was vacuumed to $5\times10^{-3}$ Pa or less and then heated; the temperature was increased to 720° C. at a speed of 10° C./min, and then the temperature was increased to 780° C. at a speed of 2° C./min, and kept at this temperature for 2 h to make the displacement reduction reaction occur between calcium and terbium fluoride, and to diffuse a part of the displaced terbium element or the terbium element in the terbium fluoride to the grain boundary inside the magnet.

S3-2) diffusion step: the temperature was increased to 950° C. at a speed of 5° C./min, and this temperature was kept for 5 h to further sufficiently diffuse the terbium element to the grain boundary inside the magnet.

S4) aging treatment step: helium was charged to cool the magnet down to 60° C. or less, and then the magnet was kept at 490° C. under 1 Pa or less for 4 h, and helium was charged again to cool the magnet down to 60° C. or less to discharge and obtain Sample 6#.

TABLE 1

Magnetic parameters of the magnets treated with different processes

| Sample No. | Remanence (kGs) | Coercive force (kOe) | Magnetic energy product ($kJ/m^3$) |
|---|---|---|---|
| 1# | 13.48 | 27.55 | 354.5 |
| 2# | 13.55 | 22.40 | 356.4 |
| 3# | 13.53 | 26.25 | 355.8 |
| 4# | 13.52 | 26.77 | 354.9 |
| 5# | 11.98 | 27.6 | 273.2 |
| 6# | 13.50 | 29.50 | 354.4 |

Table 1 shows the magnetic parameters of the magnets obtained in the above examples and comparative examples. The analysis of the measurement data: comparing Sample 1# with Sample 2#, the remanence and magnetic energy product of Sample 1# are slightly lower, while its coercive force increases significantly by 5.15 KOe; while as compared with Sample 5# in which 1 at % of dysprosium was added in the formula ingredients, the coercive force of Sample 5# is equivalent to that of Sample 1#, but its remanence and magnetic energy product are far lower than that of Sample 1#; for Sample 3#, though the coercive force is increased after infiltrating treatment, the effect is not so good as Sample 4# which was obtained by treatment with fine particles of dysprosium fluoride; while the coercive force of Sample 4# is not so good as Sample 1# which was obtained by treatment of reducing fine particles of dysprosium fluoride with calcium. The magnet Sample 6# which was obtained by terbium diffusion treatment in the method of the present invention has a larger increase of coercive force. Using the method of the present invention to treat the magnet can significantly increase the magnetic coercive force, while remanence and magnetic energy product hardly decrease. Meanwhile, the amount of heavy rare earth will be decreased by 20%-30%. This is of great importance to decrease the production cost of permanent magnet and to increase the cost performance ratio.

The present invention is not limited by the above embodiments. All variations, modifications and replacements to the disclosed embodiments which are apparent to those skilled in the art and do not depart from the essence of the present invention fall in the scope of the present invention.

What is claimed is:

1. A method for improving coercive force of magnets, comprising steps as follows:

S1) magnet manufacturing step: sintering to manufacture a magnet;

S2) coating step: coating a coating material on a surface of the magnet obtained from the magnet manufacturing step S1), and drying it;

S3) infiltrating step: heat treating the magnet obtained from the coating step S2); and S4) aging treatment step: aging treating the magnet obtained from the infiltrating step S3);

wherein the coating material is a colloidal solution which comprises metal calcium particles, particles of a material containing a rare earth element, an organic solvent and an organic binder, the material containing a rare earth element is terbium fluoride, the organic solvent is ethanol, the organic binder is epoxy resin, an average particle size of the metal calcium particles is 1.5 μm, an average particle size of the particles of terbium fluoride is 1.5 μm, a weight ratio of the metal calcium particles and the particles of terbium fluoride is 1:3.5, and an amount ratio of particles consisting of the metal calcium particles and the particles of terbium fluoride, ethanol and epoxy resin is 200 g:500 ml:0.5 g; and wherein the infiltrating step S3) is as follows: placing the magnet obtained from the coating step S2) in a vacuum sintering furnace; vacuum pumping the furnace to 0.005 Pa or less and starting to heat; increasing a temperature to 720° C. at a speed of 10° C./min, and increasing a temperature to 780° C. at a speed of 2° C./min, and keeping for 2 h to make a displacement reduction reaction occur between the metal calcium and terbium fluoride, and to diffuse a part of displaced terbium element to a grain boundary inside the magnet; and then increasing a temperature to 950° C. at a speed of 5° C./min, and keeping for 5 h to further sufficiently diffuse the rare earth element to the grain boundary inside the magnet, and wherein the aging treatment step S4) is as follow: charging helium to cool the magnet down to 60° C. or less, and then keeping the magnet at 490° C. under 1 Pa or less for 4 h, and charging helium again to cool the magnet down to 60° C. or less to discharge.

* * * * *